United States Patent [19]

Sniezak et al.

[11] Patent Number: 4,936,036

[45] Date of Patent: Jun. 26, 1990

[54] INTEGRAL GRIP CONSTRUCTION FOR HANDGUNS

[75] Inventors: Gary A. Sniezak, Windsor, Conn.; Robert J. Ferraro, Ludlow, Mass.

[73] Assignee: Smith & Wesson Corp., Springfield, Mass.

[21] Appl. No.: 371,260

[22] Filed: Jun. 26, 1989

[51] Int. Cl.[5] ..... F41C 23/00

[52] U.S. Cl. ..... 42/71.02; 42/74

[58] Field of Search ..... 42/7, 71.02, 74

[56] References Cited

U.S. PATENT DOCUMENTS

| | | |
|---|---|---|
| 1,133,281 | 3/1915 | Hammond . |
| 3,815,270 | 6/1974 | Pachmayr . |
| 4,043,066 | 8/1977 | Pachmayr et al. . |
| 4,286,401 | 9/1981 | Pachmayr et al. . |
| 4,520,585 | 6/1985 | Barrett . |
| 4,586,282 | 5/1986 | Sniezak . |
| 4,638,582 | 1/1987 | Farrar . |
| 4,833,812 | 5/1989 | Farrar . |

*Primary Examiner*—Charles T. Jordan

*Assistant Examiner*—Richard W. Wendtland

*Attorney, Agent, or Firm*—Chapin, Neal & Dempsey

[57] ABSTRACT

An integral grip for the handle of a handgun frame is molded from a resilient, flexible, synthetic plastic material. The grip is of generally U-shaped configuration including a curved rear wall and two spaced opposed sidewall portions. The sidewall portions are biased inwardly from the rear wall portion to their outer edges and are also of tapered cross-section diminishing from the rear wall to the outer edges thereof. The material, its distribution and inward bias of the sidewall portions are such that when fitted onto the handle of the handgun frame, the grip will be in tensioned, clamping relation thereon. An undercut rib is disposed on the inner surface of each sidewall portion adjacent the outer edge thereof for interlocking with a recessed edge portion of the handle. Adjacent the lower end of its rear wall portion, the grip includes a boss with a bore therethrough. The handle, itself, includes two laterally-spaced arms which also include bores aligned with the bore of the boss. A pin fitted through the aligned bores serves to fasten the grip onto the handle of the handgun.

7 Claims, 2 Drawing Sheets

INTEGRAL GRIP CONSTRUCTION FOR HANDGUNS

BACKGROUND OF THE INVENTION

The present invention relates to an integral grip for handguns molded of a resiliently flexible material with a configuration such that the grip is tensioned to exert a clamping force on the handle of the gun.

U.S. Pat. No. 3,815,270 to Pachmayr shows a handgun grip having two lateral side portions and front portion molded in flat condition and wrapped around the corresponding surfaces of the gun handle and secured in place by a plurality of screws.

U.S. Pat. No. 4,043,066 to Pachmayr shows a handgun grip comprising four separate sections (27, 29, 30 and 31) which completely encases the four sides of a gun handle. Fasteners are used to affix the sections of the grip to the handle.

U.S. Pat. No. 4,586,282 to Sniezak shows a handgun grip formed from two side sections and one rear section (26R, 26L and 28) which are separately attached using a plurality of fasteners to secure the individual grip portions to each other and to the handle.

The principal object of this invention is to provide an integrally molded grip of resiliently flexible material which is adapted to be readily and securely fitted in tensioned, clamping relation onto the handle of a handgun.

A further object of this invention is to provide an integral grip of the above type which is molded in a U-shaped configuration with side portions spring-biased toward each other to clamp securely onto the gun handle, with no exposed fasteners, for maximum grip comfort security for the shooter's hand.

The above and other objects and advantages of this invention will be more readily apparent from the following description read in conjunction with the accompanying drawings, in which.

Figure 1:
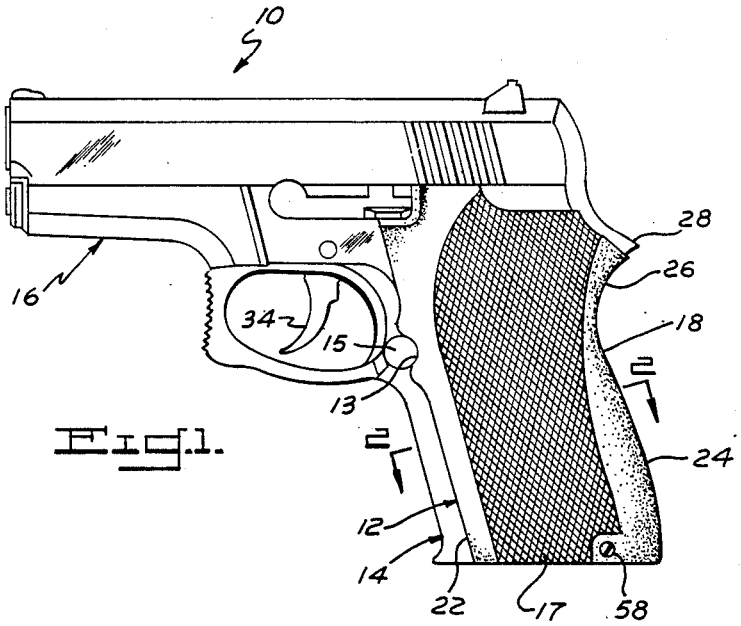
FIG. 1 is a left side elevational view of a handgun fitted with a grip of the type embodying the instant invention.

Referring in detail to the drawings, in FIG. 1 is shown a semi-automatic handgun 10 fitted with an integral hand grip 12 of the type embodying this invention. The hand grip 12 is of generally U-shaped construction (FIG. 2) and is fitted from back to front about the hollow handle portion 14 of the frame 16 of the handgun. Outer surface portions of the hand grip may be checkered, as at 17, for improved gripping characteristics.

Figure 4:
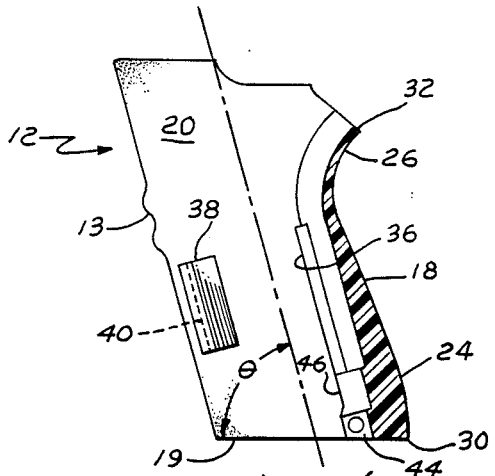
FIG. 4 is a sectional elevational view taken along line 4—4 of FIG. 3.

The grip 12 comprises an integrally molded, U-shaped member composed of resiliently, flexible synthetic plastic material which may include some elastomeric content for enhanced gripping, comfort and feel, but without loss of structural strength. The grip comprises a curved rear wall portion 18 and sidewall portions 20 and 22 which extend forwardly from the outer edges of rear wall 18, a distance somewhat less than the width of handle 14. The forward edge of walls 20 and 22 each includes a semi-circular recess 13 to accommodate a magazine catch release button 15, reversible for right and left hand shooters. Overall, the grip is canted forwardly at an oblique angle (FIG. 4) with respect to its lower edge 19 to conform to the angular orientation of the gun handle 14. In its vertical plane of symmetry, the rear wall 18 of the grip has a convexly curved outer surface of relatively large radius of curvature over the major portion of the height of the wall as at 24, and a concavely curved upper end portion of substantially smaller radius of curvature, as at 26. The concave surface 26 fairs smoothly with the underside of rear tang 28 of the frame.

In vertical cross-section (FIG. 4), the rear wall portion 18 of the grip tapers in thickness from its maximum dimension at the lower end 30 to its minimum dimension at its upper end 32 whereby the distance from surface concave 26 to the trigger 34 is minimized for easier reach and operation by the forefinger.

Figure 2:
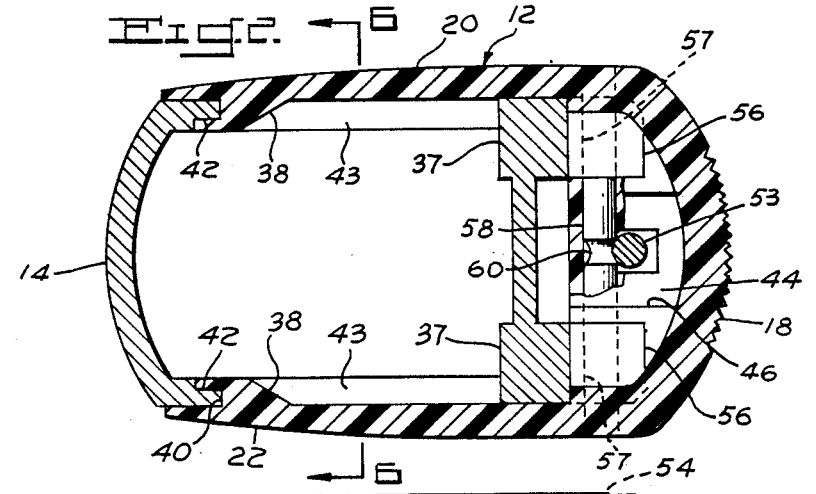
FIG. 2 is a sectional view of the grip and the handle taken along line 2—2 of FIG. 1.
Figure 3:
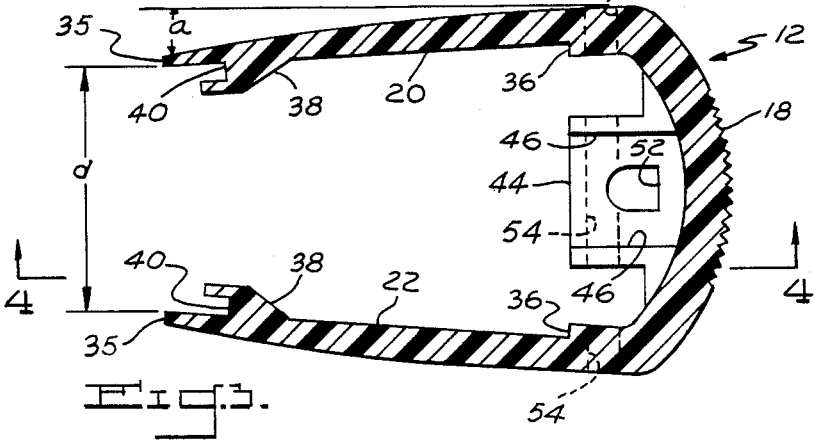
FIG. 3 is a sectional view of the grip, per se, similar to that of FIG. 2, but with the handle removed.

The rear wall 18 also has a curved horizontal cross-section, as best depicted in FIGS. 2 and 3 with generally cylindrical convex outer and concave inner surfaces. From the outer ends of curved rear wall 18, sidewalls 20 and 22 extend forwardly and each is of tapered cross-section, in a horizontal plane, from its inner to outer edge 35 where the sidewalls are of minimum thickness, while the lower portion of rear wall 18 is of maximum thickness. In addition, the sidewall portions of the grip 20 and 22 are molded with a bias or inward slope such that each is inclined or angled inwardly from a parallel relationship, as indicated at a in FIG. 3 whereby the opposed sidewalls substantially converge from their inner to outer edges. The minimum dimension d between the sidewalls is less than the width of the handgun grip at the corresponding location and inasmuch as the grip is molded of a resilient material, this construction provides a grip which is characterized by its spring-like clamping action when fitted onto the handle 14 of the handgun frame 16. As a result, the grip 12 will remain in spring-like tension, firmly clamping onto the handle 14 without the need for special fasteners to secure the sidewalls 20 and 22 firmly against the side surfaces of handle 14. Because of the greater thickness of rear wall 18 and the inward bias and taper of sidewalls 20 and 22, the grip 12 exerts an effective clamping action on the handle of the frame 16.

Figure 5:
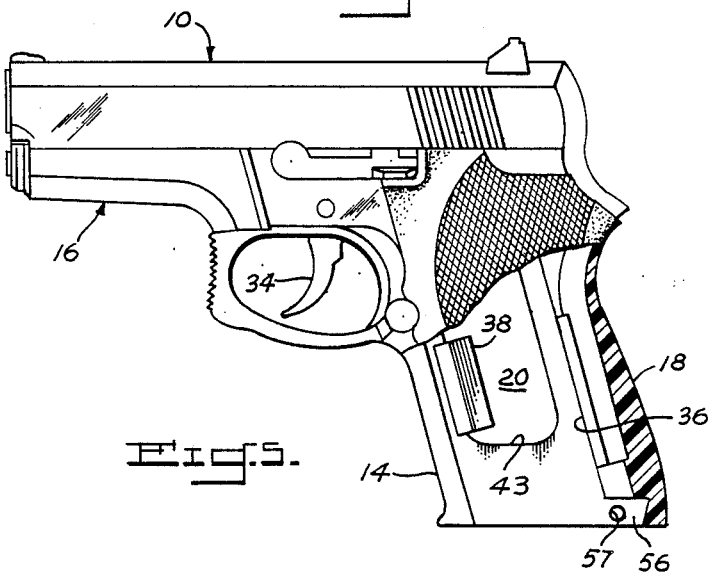
FIG. 5 is a side elevational view similar to FIG. 1, with portions cut-away to expose the opposite side of the handle and grip when in assembled relation.
Figure 6:
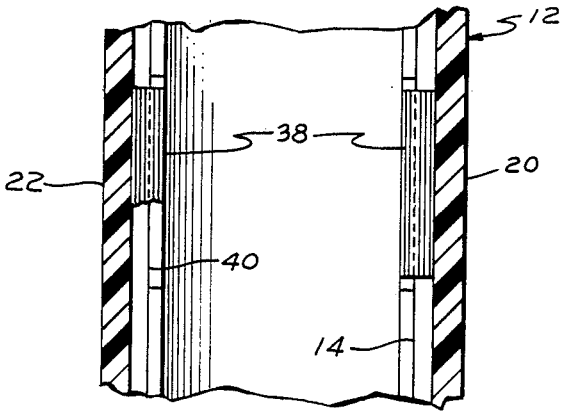
FIG. 6 is a sectional view taken along line 6—6 of FIG. 2.

Within the U-shaped grip, at the junction between the sidewalls 20 and 22 and the rear wall 18, are a pair of ribs each of which provides a locating surface or shoulder 36 (FIG. 3) adapted to abut the rear edge portions 37 (FIG. 2) of handle 14. Another pair of ribs 38 are disposed on the inner surfaces, and closely adjacent the forward edges, of the sidewalls 20 and 22. The ribs 38 are each formed with an under-cut slot or groove 40 adapted to dovetail or interfit with correspondingly recessed edges 42 provided on each side edge of the handle 14 which includes rectangular cut-outs 43 (FIG. 5).

Adjacent the lower, inner edge of rear wall 18 is a boss or block portion 44 and a pair of laterally-spaced, parallel walls 46 which extend upwardly from the outer side edges of the boss 44 to form a cavity or seat to accommodate the undersurface of the main spring plunger (not shown). The boss 44 is provided with a vertical hole 52 adapted to receive therein a projection 53 (FIG. 2) which extends from the underside of plunger. The vertical hole 52 communicates with a cylindrical bore 54 which extends laterally through the boss 44 and through axially aligned portions of sidewalls 20 and 22. The handle 12 includes a pair of laterally-spaced arms 56 which are dimensioned to fit into the spaces provided between the sidewalls and the opposed outer ends of boss 44. Each arm 56 is also provided with a cylindrical bore 57 of the same diameter as bore 54 and which, when the grip is assembled on the handle 14, will be in axial alignment with bore 54 whereby a cylindrical pin 58 may be fitted into axially aligned bores 54 in the grip and bores 57 in the handle to securely fasten the grip 12 in place on the handle 14.

Means is also provided to prevent the pin 58 being inadvertently dislodged from the bores 54 and 57. In this regard, the pin 58 includes, at approximately its center, an annular recess or groove 60 adapted to engage the projection 53 so that the pin will be retained in the aligned bores 54 and 57. Nonetheless, the pin 58 can be readily removed by pushing axially against the one end of pin 58 using an appropriately shaped implement since the plunger from which projection 53 extends will be moved upwardly against the tension of the main spring of the handgun.

Having thus described my invention, what is claimed is:

1. Integral grip for the handle of a handgun having a muzzle at its forward end and a backstrap portion which forms the rear surface of the handle comprising a U-shaped molding of resilient plastic material including a rear wall portion for engaging the backstrap and two sidewall portions extending forwardly from the outer edges of the rear wall portion, the sidewall portions being biased inwardly, in converging relation, from the rear wall toward their outer edges, the convergence being such that the lateral distance between the outer edges of said sidewalls is less than the corresponding dimension of the handgun handle such that when the grip is fitted on the handle it will be in tensioned, clamping relation thereon.

2. Integral grip for the handle of a handgun, as set forth in claim 1, in which the rear wall portion of the grip is arcuately curved in a horizontal plane and includes portions of substantially greater wall thickness than the sidewall portions of said grip.

3. Integral grip for the handle of a handgun, as set forth in claim 2, in which sidewall portions are tapered in cross-sectional thickness, decreasing from the rear wall to the outer edges of the sidewall portions.

4. Integral grip for the handle of a handgun, as set forth in claim 3, in which the rear wall includes an upper concavely curved portion adapted to be disposed at approximately the same height as the trigger of the handgun and is substantially thinner in cross-section than the lower portion of the rear wall to reduce the gripping distance from the outer surface of the thinner portion of the rear wall to the trigger of said handgun.

5. Integral grip for the handle of a handgun, as set forth in claim 4, in which the handle includes a recessed edge portion and the grip includes an undercut rib disposed on the inner surface of each sidewall portion adjacent the outer edge thereof and is adapted for interlocking with said recessed edge portion of the handle of said handgun.

6. Integral grip for the handle of a handgun, as set forth in claim 5, in which the rear wall portion of the grip includes a boss with a bore extending laterally therethrough and the handle includes a pair of laterally-spaced arms which also include bores disposed in alignment with the bore of said boss, and a pin fitted through the aligned bores to fasten the grip onto the handle of said handgun.

7. Integral grip for the handle of a handgun, as set forth in claim 6, in which a plunger is disposed at the lower end of the main spring of said handgun and a projection extends downwardly therefrom, said boss including a hole extending vertically therethrough and in communication with the lateral bore for receiving therein said projection, said pin including a reduced radius portion for engaging with the projection so that the pin will be retained in said aligned bores.

* * * * *